US007406953B2

(12) United States Patent
Lewentz

(10) Patent No.: US 7,406,953 B2
(45) Date of Patent: Aug. 5, 2008

(54) FUEL INJECTION VALVE HAVING A MECHANICAL POSITIVE-CONTROL VALVE GEAR

(75) Inventor: Günter Lewentz, Donaustauf (DE)

(73) Assignee: Siemens Aktiengesellschaft, Munich (DE)

( * ) Notice: Subject to any disclaimer, the term of this patent is extended or adjusted under 35 U.S.C. 154(b) by 119 days.

(21) Appl. No.: 10/979,454

(22) Filed: Nov. 2, 2004

(65) Prior Publication Data

US 2005/0061895 A1 Mar. 24, 2005

Related U.S. Application Data

(63) Continuation of application No. PCT/DE03/01395, filed on Apr. 30, 2003.

(30) Foreign Application Priority Data

May 3, 2002 (DE) ..... 102 19 882

(51) Int. Cl.
*F02M 37/04* (2006.01)

(52) U.S. Cl. ..... 123/501; 123/508

(58) Field of Classification Search ..... 123/90.31, 123/507, 508, 500, 501, 509, 299, 300, 90.17
See application file for complete search history.

(56) References Cited

U.S. PATENT DOCUMENTS

| | | | | | |
|---|---|---|---|---|---|
| 2,000,555 | A | * | 5/1935 | Becker | 123/508 |
| 2,073,164 | A | | 3/1937 | Meyer | |
| 2,306,364 | A | * | 12/1942 | Skaredoff | 417/493 |
| 3,698,373 | A | * | 10/1972 | Nagasawa | 123/300 |
| 3,722,490 | A | * | 3/1973 | Araya et al. | 123/179.17 |
| 3,908,613 | A | * | 9/1975 | Loby | 123/25 C |
| 4,141,329 | A | * | 2/1979 | Pompei | 123/537 |
| 4,962,743 | A | * | 10/1990 | Perr et al. | 123/496 |
| 5,081,970 | A | * | 1/1992 | Matsuoka | 123/275 |
| 5,201,300 | A | * | 4/1993 | Iiyama | 123/299 |
| 5,285,756 | A | * | 2/1994 | Squires | 123/294 |
| 5,673,659 | A | * | 10/1997 | Regueiro | 123/90.17 |
| 5,911,207 | A | * | 6/1999 | Ohishi et al. | 123/299 |
| 5,975,060 | A | * | 11/1999 | Stover et al. | 123/508 |
| 6,230,689 | B1 | * | 5/2001 | Tengroth et al. | 123/508 |
| 6,526,930 | B2 | * | 3/2003 | Takahashi et al. | 123/90.17 |
| 6,913,000 | B2 | * | 7/2005 | Hasegawa et al. | 123/508 |

FOREIGN PATENT DOCUMENTS

| | | | |
|---|---|---|---|
| FR | 707 783 | A | 12/1930 |
| NL | 72220 | C | 4/1953 |

OTHER PUBLICATIONS

PCT International Search Report Application No. PCT/DE03/01395, 2 pages (English), Mailed Sep. 2, 2003.

* cited by examiner

*Primary Examiner*—Carl S Miller
(74) *Attorney, Agent, or Firm*—Baker Botts L.L.P.

(57) ABSTRACT

The invention relates to, in particular, a fuel injection valve and to a method for injecting fuel into a combustion chamber of an internal combustion engine. According to the invention, a mechanical positive-control valve gear is provided for a nozzle needle of the fuel injection valve in order to carry out an injection of fuel.

26 Claims, 5 Drawing Sheets

FUEL INJECTION VALVE HAVING A MECHANICAL POSITIVE-CONTROL VALVE GEAR

CROSS-REFERENCE TO RELATED APPLICATION OR PRIORITY

This application is a continuation of co-pending International Application No. PCT/DE03/01395 filed Apr. 30, 2003, which designates the United States, and claims priority to German application number DE10219882.9 filed May 3, 2002.

FIELD OF THE INVENTION

The present invention relates to a fuel injection valve for injecting fuel into a combustion chamber of an engine and to a method for controlling the injection of fuel.

BACKGROUND OF THE INVENTION

Fuel injection valves are known in the prior art in different embodiments. Modern fuel injection valves are frequently used in conjunction with storage injection systems which have a pressure accumulator for storing fuel under high pressure. The injectors assigned to the individual combustion chambers of the internal combustion engine are supplied with fuel from this pressure accumulator. The fuel supply is fed to the pressure accumulator by a high-pressure pump. In order to comply with all the requirements regarding their exhaust-gas threshold values, their fuel consumption and their noise levels, etc. today's internal combustion engines need at each engine characteristic point a precisely defined curve of injection quantity over injection time. In the known fuel injection valves, the volume flow through the nozzle orifices at a certain pressure, and consequently the quantity of fuel injected per unit time, is determined by the cross-section which the nozzle needle releases depending on its respective needle lift. At a specified pressure there is therefore for each required flow rate a correspondingly associated, precisely defined nozzle needle lift. Consequently, in order to set a certain volume flow, the nozzle needle would have to be set to a certain lift value. In order to execute a certain shaped injection curve, the nozzle needle would have to be raised within an injection cycle to several precisely defined positions and possibly even lowered again. In today's known fuel injection valves, however, there are only two precisely defined needle positions, namely zero (valve closed) and full lift (valve fully open). Therefore, only two precisely defined flow rates are also possible, namely zero flow rate and maximum flow rate.

Each flow-rate value which lies between these two extremes can always be achieved only approximately, since in the known injection valves the appropriate needle lift can be set only very imprecisely through modulation of the pressure. As this is done, the nozzle needle "rides" on a hydraulic cushion and is thus also subject to the pressure waves and fluctuations present in the nozzle. As a result, however, instead of the necessary, precisely defined needle lift stop for accurately controlling the injection quantity, only an approximate ballistic stopping point of the nozzle needle is produced. This results in approximate, highly scattered and very poorly reproducible injection quantities, which leads to a below-optimum combustion sequence with associated poor results in terms of emissions, noise and fuel consumption.

In the currently known methods for controlling the flow of fuel into the combustion chamber, this flow is always controlled only indirectly, i.e., the control of the nozzle needle is carried out only indirectly via a hydraulic servo-circuit. Here, however, the temporal and quantitative metering of fuel into the combustion chamber depends on very many influencing factors of this servohydraulic system and fluctuates correspondingly widely, which in turn impacts negatively on the quality of combustion in the engine. In particular, digital switching of the servo-valve (open/closed) cannot carry out any precise shaping of the injection characteristics. In particular, in the lower partial-load range, in which the nozzle needle finds itself while injecting between these two extreme positions, the undefined position of the nozzle needle leads to widely varying and non-reproducible injection quantities. The same problem is exhibited by the pump-nozzle systems also known today, since these also open or close the nozzle needle only indirectly by modulating pressure at the shutoff valve.

SUMMARY OF THE INVENTION

The object of the present invention is therefore to provide a fuel injection valve for injecting fuel into a combustion chamber of an internal combustion engine and a method for injecting fuel which enable precisely definable actuation of nozzle-needle opening positions and are easily reproducible.

A fuel injection valve including a nozzle needle for injecting fuel into a combustion chamber of an internal combustion engine, said valve comprising a mechanical positive-control valve gear for the nozzle needle.

A method for the injection of fuel into a combustion chamber of an internal combustion engine, said method comprising controlling the injection of fuel in a mechanically positive manner.

A fuel injection system for an internal combustion engine, said system comprising a fuel injection valve, said fuel injection valve comprising a nozzle needle, a tipping lever in communication with the nozzle needle, and a camshaft in communication with the tipping lever, wherein movement of the camshaft moves the tipping lever to move the nozzle needle.

A fuel injection system for an internal combustion engine, said system comprising a fuel injection valve, said valve including a nozzle needle, a tipping lever, swing lever, drag lever, or a key rod in communication with the nozzle needle, and a three dimensional camshaft, cam plate or curve template in communication with tipping lever, swing lever, drag lever, or key rod, whereby an axial shift provides for different opening characteristics of the nozzle needle.

The fuel injection valve according to the invention for injecting fuel into a combustion chamber of an internal combustion engine is constructed such that a nozzle needle of the fuel injection valve is positively controlled mechanically. This mechanical positive control of the nozzle needle enables defined actuation of any positions between the two extreme positions of the nozzle needle, namely fully open and fully closed. The mechanical positive-control valve gear thus provides in each case a stop for the nozzle needle so that a defined quantity of fuel can always be injected into the combustion chamber. By means of the mechanical positive-control valve gear, the injection of fuel is also readily reproducible. Thus, the fuel injection curve can be shaped through appropriate design of the mechanical positive-control valve gear, i.e. of the geometry of the mechanical positive-control valve gear. Direct coupling of a mechanical control element with the nozzle needle thus occurs through the combination according to the invention of a mechanical positive-control valve gear and a fuel injection valve. Due to this positive control, the nozzle needle no longer has any degree of freedom since it has to follow the mechanical control element. By this means, precise and reproducible positive control of the nozzle needle, which is, in particular, independent of the pressure of the injected fuel, can be achieved in a surprisingly simple manner even for one skilled in the art. The mechanical positive-control valve gear is easily constructed and can be provided at relatively low cost. Furthermore, only a small space is required for mounting the mechanical positive-control valve gear. In addition to that, the combination according to the invention also simplifies the design of the fuel injection valve, since only a mechanical connection is necessary between the mechanical control element and the nozzle needle. The present invention thus enables in a surprisingly simple manner precise shaping of the injection of fuel and can by this means enable a positive impact to be made on the exhaust-gas threshold values, fuel consumption and noise of the internal combustion engine.

The mechanical positive-control valve gear is preferably provided for opening the nozzle needle and/or for closing the nozzle needle. If the mechanical positive-control valve gear is to be used both for opening and for closing the nozzle needle, this can preferably be executed by means of positive nozzle-needle control, in which e.g. a first tipping lever is provided for opening and a second tipping lever for closing. Through the positive control of the valve, the nozzle needle can be opened wide rapidly even at high engine speeds and remain open for as long as required before being closed again quickly and yet smoothly because of its precision. This means that even where the stroke is long, no long control times are required, which produces positive effects on the engine characteristics at low to medium engine speeds since the nozzle needle responds immediately to the specifications of the mechanical control element and does not lag to a greater or lesser extent depending on the engine speed because of the dynamic spring/mass processes in the case of valves opened or closed by means of springs. If the mechanical positive-control valve gear is to be used only for opening or only for closing the nozzle needle, the respective movement occurs preferably against an elastic force of a spring and the opposing movement, i.e. the closing or opening, is than effected by the spring.

According to an embodiment of the present invention, the mechanical positive control is carried out directly or indirectly (via mechanical connecting elements) by means of a camshaft or a cam plate or a curve template. In the case of these mechanical positive control options, transfer of the power and/or displacement of the stroke can of course also be carried out by interposing mechanical members such as e.g. tipping levers, swing levers, drag levers or key rods.

In order to enable any valve clearance to be compensated for, valve-clearance compensating elements, e.g. with hydraulic valve-clearance compensation, must preferably also be provided.

According to a further embodiment of the present invention, the mechanical positive-control valve gear is fashioned three-dimensionally. By this means, an adaptation can also be achieved in a simple manner to different stroke movements. In the three-dimensionally fashioned mechanical positive-control valve gear, the mechanical control elements (camshaft, cam plate or curve template) are also fashioned in the third dimension so that, by shifting axially, different nozzle-needle opening characteristics which are suited to the respective engine status can be executed. For example, for higher engine speeds, a pre-injection that is no longer needed can be modeled by this means in favor of an additional main injection and/or post-injection. The third dimension of the mechanical cam thus makes it possible also to define according to the load and engine speed of the internal combustion engine the correspondingly optimum needle-stroke characteristics.

In the case of a mechanical control element fashioned as a camshaft, the drive for all fuel injection valves is preferably provided directly via a single camshaft. This camshaft is in turn preferably driven directly by the internal combustion engine. Such a design is deemed to have the crucial advantage that the engine design can be executed significantly more simply and easily. In this way also, only small forces are required for the mechanical positive control of the nozzle needle. Furthermore, the drive of the nozzle needle of each injection valve is optimally synchronized through the direct linkage to the engine speed.

According to another embodiment of the present invention, the drive of the fuel injection nozzles occurs via a separate camshaft which is driven for example by an electric motor. However, in this case, appropriate sensors and actuators would have to be provided in order to achieve synchronization with the engine speed. An advantage of this variant, however, is that, in particular, an axial shift of the camshaft to adapt the cam (three-dimensional) to the engine status is easily implementable.

According to a further embodiment of the present invention, a separate mechanical positive-control valve gear with integrated individual drive is provided for each fuel injection valve. By this means, customized adjustments of the individual fuel injection valves are possible, although this does signify a corresponding additional outlay, since a mechanical cam with appropriate drive has to be integrated for each fuel injection valve.

It should generally be noted that suitable drives for the mechanical positive-control valve gear include, for example, electric motors, electromagnets, piezoactuators, hydraulic drives and/or spring works. Furthermore, in the case of rotatory mechanical cams, the cam can, through twisting of the rotatory control element, be adjusted easily.

In the case of translational control elements (linear cam), lifting magnets, piezoactuators, hydraulic pistons and/or pneumatic pistons, for example, can be used as drives. Expressed in general terms, the injection of fuel can thus be set by adjusting the respective mechanical control elements. The adjustment can be carried out here by twisting and/or (in the case of three-dimensional control elements) axially shifting the control elements.

The fuel injection valve according to the invention is particularly preferably used in combination with a storage injection system such as, e.g., a common-rail system, since in this case the generation of pressure and the storage of pressure are handled by other components. Here, control of the nozzle needle has the sole function of defining according to the pressure being applied in the pressure accumulator of the storage injection system the quantity of fuel injected per unit time. Furthermore, the pressure accumulator enables the maintenance of a constant pressure so that the injection of fuel can be carried out with maximum precision by the positive-control valve gear according to the invention.

The above mentioned advantages can be achieved by means of the method according to the invention which uses a mechanical positive control for controlling the nozzle-needle of a fuel injection engine with a direct-injection system.

As a result of the positive coupling of the nozzle needle according to the invention, the nozzle needle no longer has any degree of freedom. It has to follow the specified mechanical cam, thereby guaranteeing high reproducibility of the nozzle-needle stroke. The mechanical cam thus constitutes a stroke stop that is fixed for a defined injection time but is variable within the injection cycle as a whole. This enables minimally possible shot-to-shot control. According to the invention, an adaptation to different engine speeds can be achieved by proceeding along the mechanical cam at different speeds. This is possible, in particular, where there is a direct coupling between the internal combustion engine and the nozzle needle, e.g. via a camshaft. Thus, according to the invention, a nozzle-needle control which is in many respects advantageous is achieved in fuel direct-injection valves in a manner which is surprisingly simple even for one skilled in the art.

DETAILED DESCRIPTION OF EMBODIMENTS OF THE INVENTION

A fuel injection valve according to a first exemplary embodiment of the present invention is described below with reference to FIGS. 1 and 2.

Figure 1:
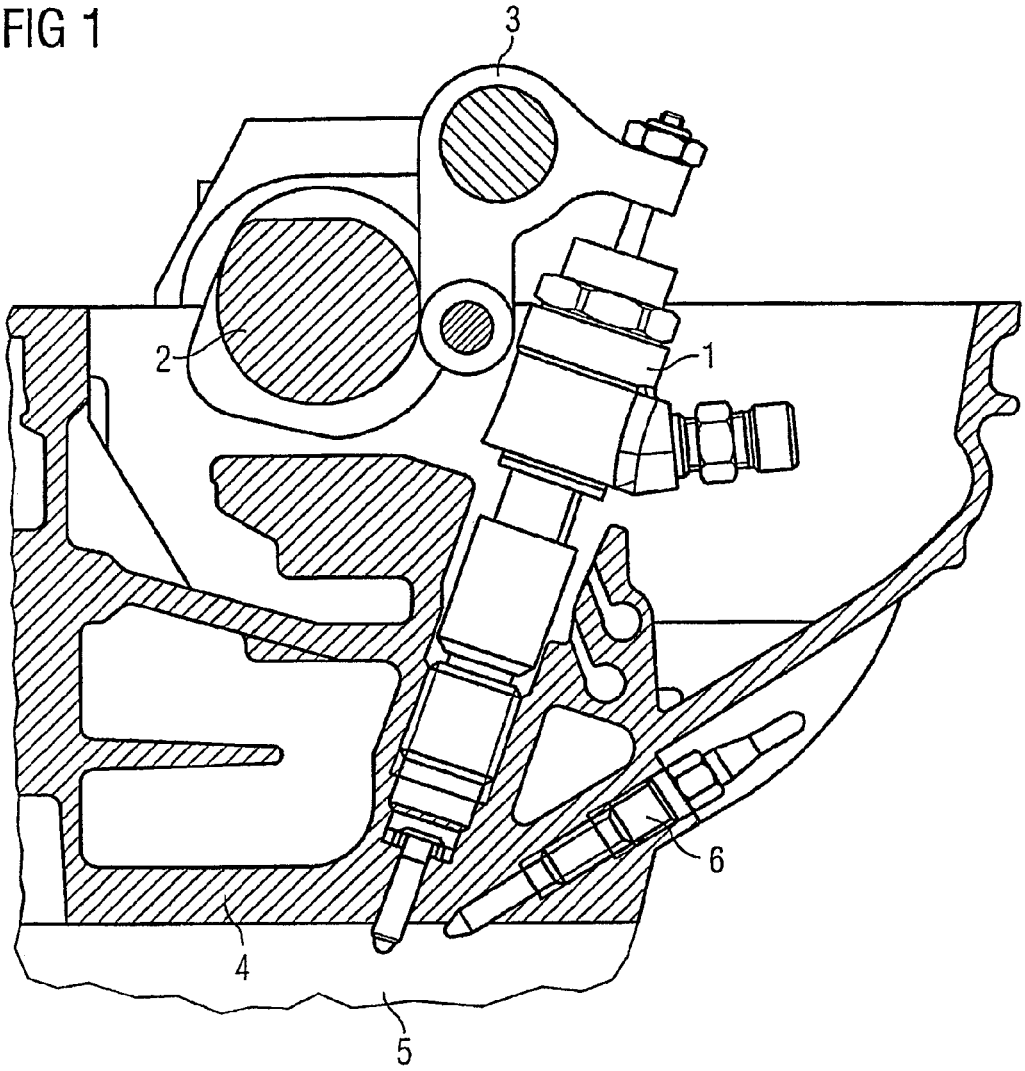
FIG. 1 shows a lateral view of a fuel injection valve according to a first embodiment of the present invention in assembled condition.

As shown in the summary diagram in FIG. 1, the fuel injection valve 1 is arranged in a known manner in an engine housing 4 such that it can inject fuel directly into a combustion chamber 5 of the internal combustion engine. The fuel/air mixture in the combustion chamber is ignited by means of a spark plug 6. As can further be seen from FIG. 1, a camshaft 2 is provided as mechanical positive-control valve gear, said camshaft being connected via a tipping lever 3 directly to a nozzle needle 7 of the fuel injection valve.

FIG. 2 shows once again in detail the structure of the fuel injection valve 1 according to the invention. As shown in FIG. 2, the fuel injection valve 1 comprises the nozzle needle 7 which releases or closes a sealing seat 8 in order to inject fuel into the combustion chamber 5 or to terminate an injection. The fuel injection valve 1 is made up of a nozzle body 9 and an injector body 15 in which a high-pressure bore 11 is arranged. The nozzle needle 7 is arranged in the nozzle body 9 and is guided in this nozzle body. The end of the nozzle needle 7 opposite the sealing seat 8 is connected to a clamping bolt 12 which is used for fixing a pull rod 16. By this means, the pull rod 16 is rigidly connected to the nozzle needle 7. Also arranged in the injector body 15 are a compression spring 13 and a spring adjustment brace 14. The clamping bolt 12 serves simultaneously also as a spring seat for the compression spring 13 (cf. FIG. 2). In the embodiment shown in FIG. 2, the compression spring 13 serves to reset the nozzle needle 7 to its closed position on the sealing seat 8. The components 9, 15 are braced against one another in a known manner by means of a nozzle adjusting nut 10.

Figure 2:
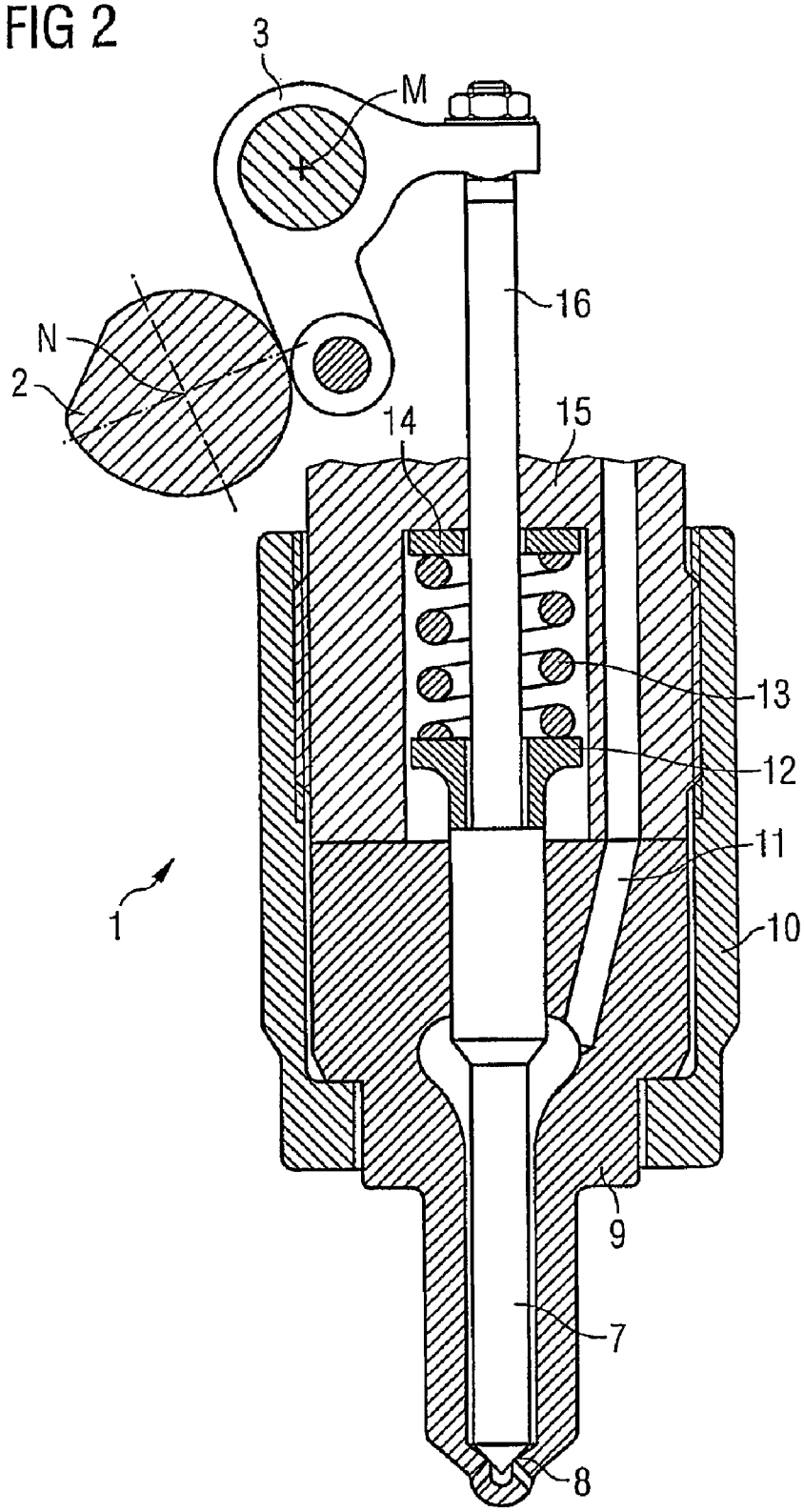
FIG. 2 shows a sectional view of the fuel injection valve shown in FIG. 1.

Furthermore, the pull rod 16 is connected to one end of the tipping lever 3, the other end of the tipping lever 3 being connected to the camshaft 2 (cf. FIG. 2). The tipping lever can rotate about an axis M.

The function of the fuel injection valve according to the invention is described below. As can be seen from FIG. 2, the outer contour of the camshaft 2 prescribes the process of the injection of fuel into the combustion chamber. Here, the camshaft 2 and the tipping lever 3 are arranged such that the tipping lever 3 remains in continuous contact with the camshaft 2 and thus, proceeds along its contour when the camshaft is rotated about its axis of rotation N. Since, in this process, the tipping lever 3 rotates about its axis of rotation M and is fixed by means of a nut on the pull rod 16, the nozzle needle 7 can be lifted via the pull rod 16 from its sealing seat and moves upward so that an injection of fuel can occur.

The mechanical positive control for the nozzle needle of the fuel injection valve is thus achieved by means of the connection between the pull rod 16 and the tipping lever 3 to the camshaft 2. When the camshaft 2 rotates about its axis N, the tipping lever 3 scans the outer contour of the camshaft 2 and as it does so rotates accordingly about its axis M, as a result of which the nozzle needle 7 moves.

Resetting of the nozzle needle 7 occurs here by means of the spring tension of the compression spring 13. In this case, the initial stressing force of the compression spring 13 has to be greater than the force which is produced by the pressure present in the high-pressure bore 11 and the pressurized surface when the nozzle needle 7 is fully open. If, for example, the pressure in the high-pressure bore stands at 1600 bar and the diameter of a needle guide is 4 mm, then the required spring tension F of the compression spring 13 is given by: $F=1600\ \text{bar}\cdot\pi/4\cdot 42=2010$ N. Thus, the nozzle needle 7 is controlled by means of a mechanical positive-control valve gear. How fast the nozzle needle 7 moves from its seat, or how great the needle stroke is at a certain point in time of the injection, or whether the nozzle needle 7 is pressed back on to its sealing seat 8 after a first preliminary injection, depends solely on the given geometry of the outer contour of the camshaft.

In order to guarantee high reproducibility of control over the cycle time, the point of contact between the nozzle needle 7 and the cam must be designed so as to be appropriately wear-free. To this end, minimum possible compressive loads per unit area (hertzian pressure) must be sought through maximum possible contact radii, optimum possible surface qualities, reduced-wear coatings and/or optimum possible lubricating conditions. Furthermore, friction can also be influenced by an appropriate choice of materials of the frictional parts in contact with one another. It must also be ensured that the nozzle needle 7 for closing the nozzle can be lowered unhindered and freely into its sealing seat 8. For this, the minimum possible clearance is required between the cam and the nozzle needle when the nozzle is closed.

It should also be noted that in order to ensure defined tracing of the needle movement at any time of the injection process, there must if possible always be a form fit between the cam and the nozzle needle. Any lifting of the control roller from the cam must therefore be avoided. It is therefore important to execute the design and the adjustment of the spring tension particularly precisely.

According to the invention, a simply constructed mechanical positive-control valve gear can thus be provided so as to ensure a high degree of precision of injection and very good reproducibility of individual injection cycles. By rotating the camshaft, or in the case of a three-dimensional cam on the camshaft, by axially shifting the camshaft, the mechanical positive-control valve gear can be adjusted in a simple manner and the injection of fuel thus adapted to different states of the internal combustion engine.

Figure 3A:
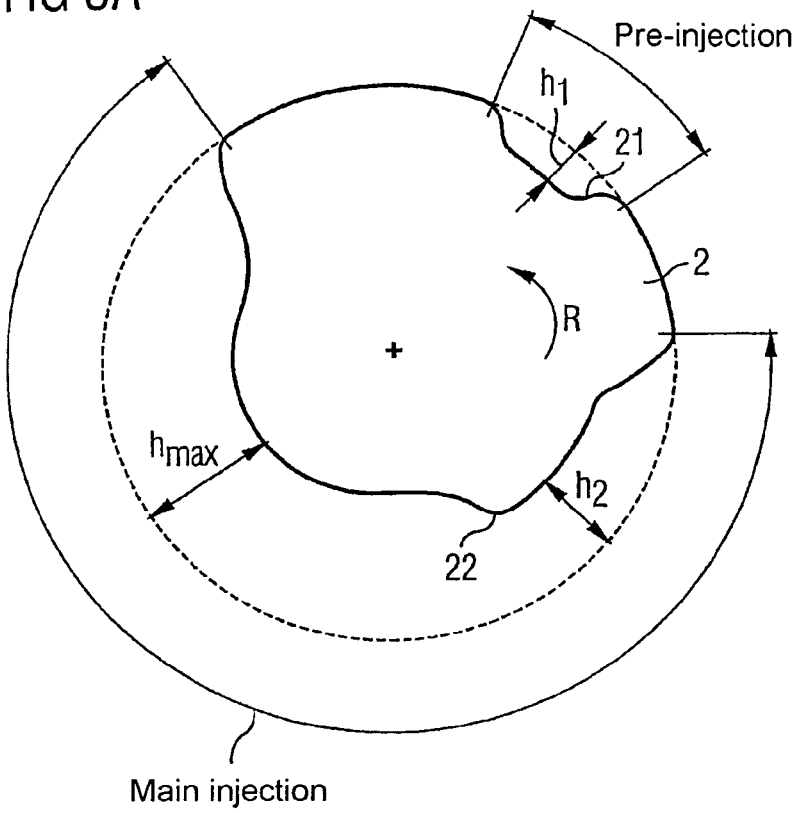
FIG. 3*a* shows a sectional view of a camshaft illustrating the underlying control principle.

FIGS. 3 and 4 show by way of example embodiments of a rotatory mechanical control element such as e.g. a camshaft or a cam plate, firstly schematically and then according to a second embodiment. As shown in FIG. 3*a*, which is intended to illustrate in basic terms the principle of control by means of a camshaft, the rotatory cam 2 is rotated in the direction of the arrow R and has two recesses 21 and 22 in its circumference in order to define an injection of fuel. Here, a first recess 21 having a depth h1 is provided for a preliminary injection and the second recess 22 runs over more than half of the circumference and is provided for the main injection. Here, determined by the height h2 in the main injection, a small quantity of fuel is injected initially until the main injection then switches to the height hmax in which the nozzle needle is fully open.

Figure 4A:
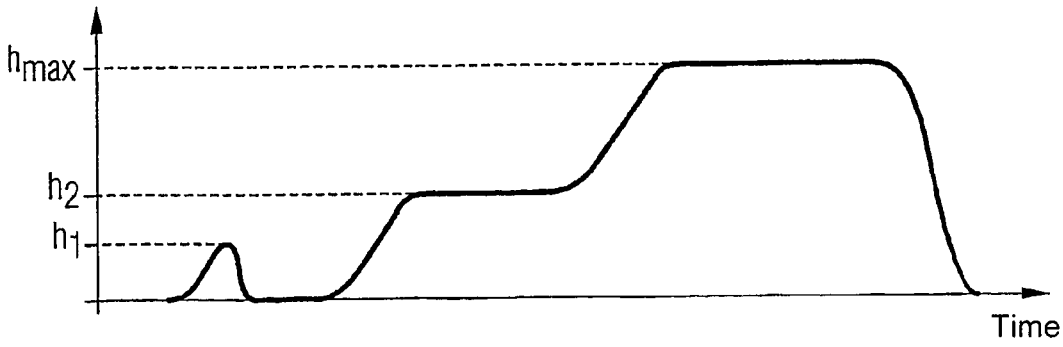
FIG. 4*a* shows a graphic representation of a needle stroke over time, schematically when the camshaft shown in FIG. 3*a* rotates.

FIG. 4*a* shows a graphic representation of a needle stroke schematically over time when the camshaft shown in FIG. 3*a* is rotated.

Figure 3B:
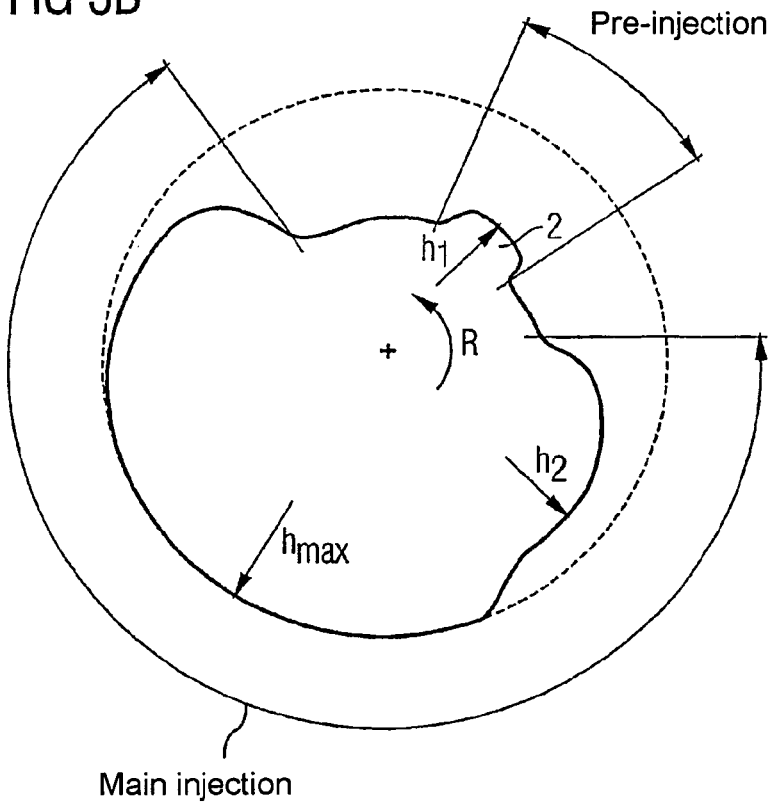
FIG. 3*b* shows a sectional view of a camshaft fashioned inversely by comparison with FIG. 3*a* according to a second exemplary embodiment of the present invention.

FIG. 3*b* shows the special sectional view of a camshaft according to a second embodiment of the present invention, fashioned inversely compared with FIG. 3*a*.

Figure 4B:
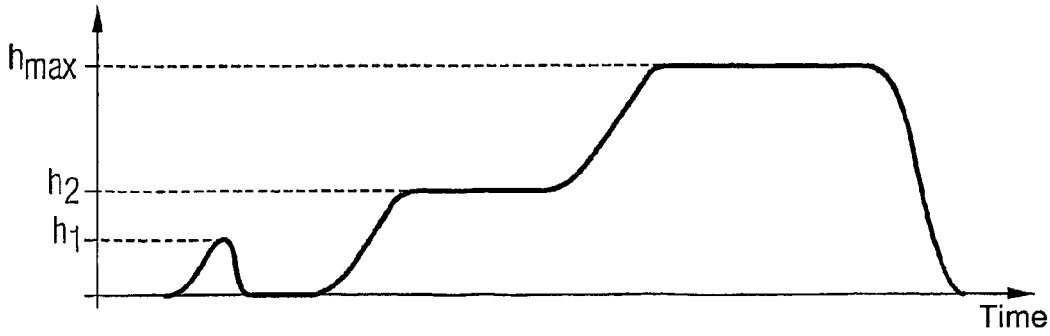
FIG. 4*b* shows a graphic representation of the needle stroke over time, when the camshaft shown in FIG. 3*b* rotates.

FIG. 4*b* shows the needle stroke, when the camshaft shown in FIG. 3*b* is rotated, during a complete revolution of the rotatory cam 2 over time, the flow rate being greater, the greater the needle stroke.

Figure 5:
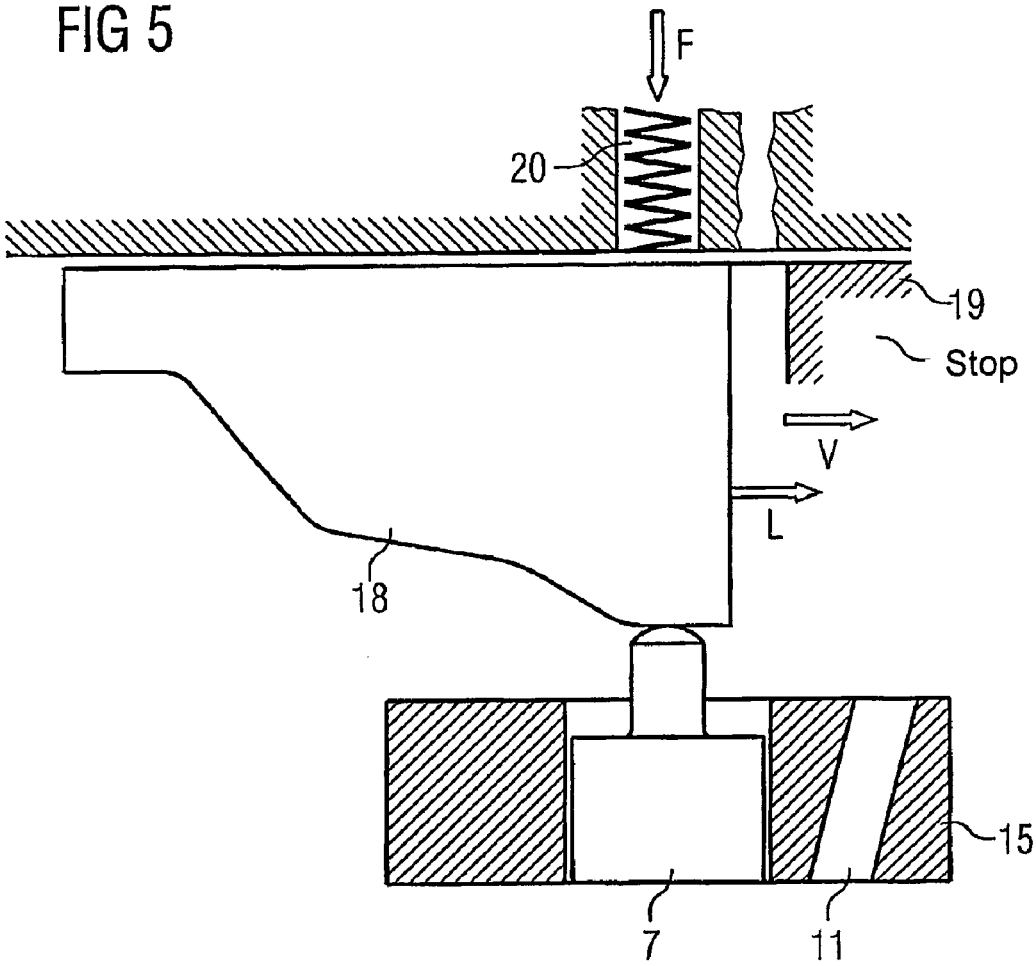
FIG. 5 shows a sectional view of a mechanical control element according to a third embodiment of the present invention.
Figure 6:
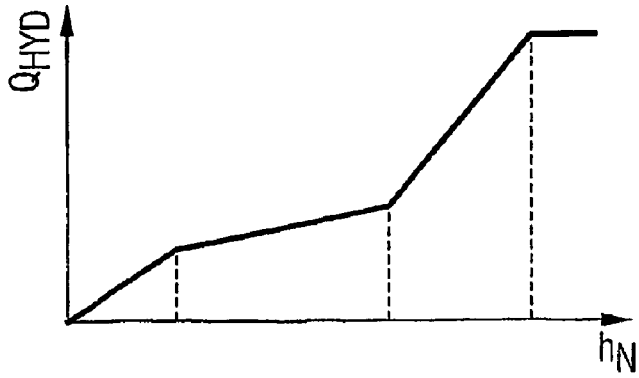
FIG. 6 shows a graphic representation of the quantity of fuel injected depending on the needle stroke in the control device shown in FIG. 5.

FIGS. 5 and 6 show a mechanical positive-control valve gear according to a third embodiment.

In contrast with the preceding mechanical positive-control valve gears, a curve template 18 is provided in the mechanical positive-control valve gear of the third embodiment in order to execute a translatory mechanical positive control. The curve template 18 executes a translatory movement in the direction of the arrow L until it strikes a stop 19. The curve template 18 is prestressed here by means of a spring 20 which provides a spring tension F. If the curve template 18 is moved in the direction of the arrow L, the end of the nozzle needle 7 which is continuously in contact with the curve template runs along the geometry of the curve template 18 so that in a manner corresponding to the geometry an opening or closing of the fuel injection valve occurs. FIG. 6 shows the flow rate Qhyd over the stroke height hN of the nozzle needle 7. An adaptation to different engine speeds is carried out here by changing the velocity of movement v of the curve template 18. Otherwise, this embodiment matches the embodiments described previously so that a more detailed description can be dispensed with.

In conclusion, the present invention thus relates to a fuel injection valve and to a method for injecting fuel into a combustion chamber 5 of an internal combustion engine, a mechanical positive-control valve gear 2, 3 being provided for a nozzle needle 7 of the fuel injection valve in order to execute an injection of fuel.

The present invention is not restricted to the embodiments shown. Different variations and changes can be implemented without departing from the scope of the invention.

What is claimed is:

1. A fuel injection system for an internal combustion engine, said system comprising:

a fuel reservoir comprising fuel pressurized at a fluid pressure;

a fuel injection valve, said valve comprising a nozzle needle, wherein the nozzle needle is opened and closed independent of the fuel fluid pressure;

a lever selected from a tipping lever, a swing lever, a drag lever, and a key rod, wherein the lever is directly mechanically coupled to the nozzle needle;

a mechanical positive-control valve gear selected from a three dimensional camshaft, a cam plate and a curve template, wherein the mechanical positive-control valve gear positively controls the nozzle needle by direct mechanical contact with the lever; and a camshaft coupled to the mechanical positive-control valve gear, wherein an axial shift of the camshaft provides for different opening characteristics of the nozzle needle, wherein a fuel injection curve as a function of engine cycle depends upon the geometry of the mechanical positive-control valve gear, wherein said mechanical positive-control valve gear comprises a profile that provides a plurality of distinct opening positions at different times to provide for a pre-injection and a main injection within a running injection cycle, wherein the profile comprises at least two recesses corresponding to the pre-injection and the main injection respectively.

2. A fuel injection system as claimed in claim 1, wherein the mechanical positive-control valve gear opens the nozzle needle, closes the nozzle needle, or opens and closes the nozzle needle.

3. A fuel injection system for an internal combustion engine, said system comprising:

a fuel reservoir comprising fuel pressurized at a fluid pressure;

a fuel injection valve, said valve comprising a nozzle needle, wherein the nozzle needle is opened and closed independent of the fuel fluid pressure;

a lever selected from a tipping lever, a swing lever, a drag lever, and a key rod, wherein the lever is directly mechanically coupled to the nozzle needle;

a mechanical positive-control valve gear selected from a three dimensional camshaft, a cam plate and a curve template, wherein the mechanical positive-control valve gear positively controls the nozzle needle by direct mechanical contact with the lever; and a camshaft coupled to the mechanical positive-control valve gear, wherein an axial shift of the camshaft provides for different opening characteristics of the nozzle needle, wherein a fuel injection curve as a function of engine cycle depends upon the geometry of the mechanical positive-control valve gear, wherein said mechanical positive-control valve gear comprises a profile that provides a pre-injection and a main injection within a running injection cycle, wherein the main injection is divided into a first injection period during which the nozzle needle is opened at a first opening position and a second injection period following said first injection period during which the nozzle needle is opened at a second opening position, wherein the second opening position provides a greater opening than said first opening position.

4. A fuel injection system as claimed in claim 1, further comprising valve-clearance compensating elements.

5. A fuel injection system as claimed in claim 1, wherein the camshaft is driven by the internal combustion engine.

6. A fuel injection system for an internal combustion engine, said system comprising:

a fuel reservoir comprising fuel pressurized at a fluid pressure;

a fuel injection valve, said valve comprising a nozzle needle, wherein the nozzle needle is opened and closed independent of the fuel fluid pressure;

a lever selected from a tipping lever, a swing lever, a drag lever, and a key rod, wherein the lever is directly mechanically coupled to the nozzle needle;

a mechanical positive-control valve gear selected from a three dimensional camshaft, a cam plate and a curve template, wherein the mechanical positive-control valve gear positively controls the nozzle needle by direct mechanical contact with the lever; and a camshaft coupled to the mechanical positive-control valve gear, wherein an axial shift of the camshaft provides for different opening characteristics of the nozzle needle, wherein a fuel injection curve as a function of engine cycle depends upon the geometry of the mechanical positive-control valve gear, wherein the camshaft is driven by a drive system separate from the internal combustion engine, wherein the drive system is synchronized with the speed of the internal combustion engine to operate the fuel injection valve.

7. A fuel injection system as claimed in claim 1, wherein an operating speed of the mechanical positive-control valve gear is adjustable.

8. A fuel injection system for an internal combustion engine, said system comprising:

a fuel reservoir comprising fuel pressurized at a fluid pressure;

a fuel injection valve, said valve comprising a nozzle needle, wherein the nozzle needle is opened and closed independent of the fuel fluid pressure;

a lever selected from a tipping lever, a swing lever, a drag lever, and a key rod, wherein the lever is directly mechanically coupled to the nozzle needle;

a mechanical positive-control valve gear selected from a three dimensional camshaft, a cam plate and a curve template, wherein the mechanical positive-control valve gear positively controls the nozzle needle by direct mechanical contact with the lever; and a camshaft coupled to the mechanical positive-control valve gear, wherein an axial shift of the camshaft provides for different opening characteristics of the nozzle needle, wherein a fuel injection curve as a function of engine cycle depends upon the geometry of the mechanical positive-control valve gear, wherein the mechanical positive-control valve gear comprises a profile that provides a plurality of distinct opening positions at different times to provide for a pre-injection and a main injection within a running injection cycle, wherein the profile of the valve gear closes the needle nozzle between said pre-injection and said main injection.

9. A fuel injection system for an internal combustion engine, said system comprising:

a fuel reservoir comprising fuel pressurized at a fluid pressure;

a fuel injection valve, said valve comprising a nozzle needle, wherein the nozzle needle is opened and closed independent of the fuel fluid pressure;

a lever selected from a tipping lever, a swing lever, a drag lever, and a key rod, wherein the lever is directly mechanically coupled to the nozzle needle;

a mechanical positive-control valve gear selected from a three dimensional camshaft, a cam plate and a curve template, wherein the mechanical positive-control valve gear positively controls the nozzle needle by direct mechanical contact with the lever, wherein the valve gear comprises a profile that provides a plurality of distinct opening positions at different times to provide for a pre-injection and a main injection within a running injection cycle, wherein the profile comprises at least two recesses corresponding to the pre-injection and main injection respectively, wherein the profile of the valve gear closes the needle nozzle between the pre-injection and the main injection, wherein the fuel injection curve divides the main injection into a first injection period during which the nozzle needle is opened at a first opening position and a second injection period following said first injection period during which the nozzle needle is opened at a second opening position such that the second opening position provides a greater opening than the first opening position, wherein a fuel injection curve as a function of engine cycle depends upon the geometry of the mechanical positive-control valve gear; and a camshaft coupled to the mechanical positive-control valve gear, wherein an axial shift of the camshaft provides for different opening characteristics of the nozzle needle.

10. A fuel injection system as claimed in claim 9, wherein the mechanical positive-control valve gear opens the nozzle needle, closes the nozzle needle, or opens and closes the nozzle needle.

11. A fuel injection system according to claim 9, further comprising valve-clearance compensating elements.

12. A fuel injection system according to claim 9, wherein the camshaft is driven by the internal combustion engine.

13. A fuel injection system according to claim 9, wherein the camshaft is driven by a drive system separate from the internal combustion engine, wherein the drive system is synchronized with the speed of the internal combustion engine to operate the fuel injection valve.

14. A fuel injection valve according to claim 9, wherein an operating speed of the mechanical positive-control valve gear is adjustable.

15. A fuel injection system as claimed in claim 3, wherein the mechanical positive-control valve gear opens the nozzle needle, closes the nozzle needle, or opens and closes the nozzle needle.

16. A fuel injection system as claimed in claim 3, further comprising valve-clearance compensating elements.

17. A fuel injection system as claimed in claim 3, wherein the camshaft is driven by the internal combustion engine.

18. A fuel injection system as claimed in claim 3, wherein an operating speed of the mechanical positive-control valve gear is adjustable.

19. A fuel injection system as claimed in claim 6, wherein the mechanical positive-control valve gear opens the nozzle needle, closes the nozzle needle, or opens and closes the nozzle needle.

20. A fuel injection system as claimed in claim 6, further comprising valve-clearance compensating elements.

21. A fuel injection system as claimed in claim 6, wherein the camshaft is driven by the internal combustion engine.

22. A fuel injection system as claimed in claim 6, wherein an operating speed of the mechanical positive-control valve gear is adjustable.

23. A fuel injection system as claimed in claim 8, wherein the mechanical positive-control valve gear opens the nozzle needle, closes the nozzle needle, or opens and closes the nozzle needle.

24. A fuel injection system as claimed in claim 8, further comprising valve-clearance compensating elements.

25. A fuel injection system as claimed in claim 8, wherein the camshaft is driven by the internal combustion engine.

26. A fuel injection system as claimed in claim 8, wherein an operating speed of the mechanical positive-control valve gear is adjustable.

* * * * *